US005911177A

United States Patent [19]

Fox et al.

[11] Patent Number: 5,911,177

[45] Date of Patent: Jun. 15, 1999

[54] SPLIT FRAME TABLE

[75] Inventors: Bryan M. Fox, Frankfort, Ill.; Roman J. Rabiej, Mattawan; Dmitry Azrikan, Kalamazoo, both of Mich.

[73] Assignee: The Board of Trustees of Western Michigan University, Kalamazoo, Mich.

[21] Appl. No.: 09/005,380

[22] Filed: Jan. 9, 1998

[51] Int. Cl.[6] ..... A47B 85/00

[52] U.S. Cl. ..... 108/15; 108/157.17; 108/12; 312/140.2; 206/588; 206/449; 206/326

[58] Field of Search ..... 108/115, 124, 108/25, 157.17, 157.1, 41, 33, 15, 17, 11, 12, 14; 312/262, 258, 241, 140.2; 206/588, 449, 326, 451; 248/460; 160/135; 52/70, 71, 64, 653.1, 656.1, 580, 581, 582.1, 645, 646, 36.1, 656.8

[56] References Cited

U.S. PATENT DOCUMENTS

| | | | |
|---|---|---|---|
| 1,259,580 | 3/1918 | Wurz | 108/15 X |
| 1,421,299 | 6/1922 | Palen | 52/93 |
| 2,771,334 | 11/1956 | Wahlbom | 312/140.2 |
| 2,844,257 | 7/1958 | Friedman | 108/11 X |
| 3,841,728 | 10/1974 | Petersen et al. | 312/140.1 |
| 4,285,176 | 8/1981 | Runkle | 52/653.1 X |
| 4,974,526 | 12/1990 | Wiygul, Jr. | 312/140.2 X |

FOREIGN PATENT DOCUMENTS

| | | | |
|---|---|---|---|
| 653120 | 11/1937 | Germany | 108/33 |
| 668398 | 12/1938 | Germany | 108/124 |
| 196367 | 4/1923 | United Kingdom | 108/15 |
| 610982 | 4/1949 | United Kingdom | 108/14 |

*Primary Examiner*—Peter M. Cuomo
*Assistant Examiner*—Janet M. Wilkens
*Attorney, Agent, or Firm*—Flynn, Thiel, Boutell & Tanis, P.C.

[57] ABSTRACT

A split frame table has a planar table top and a base. The base has several panels that are rotatably joined via hinges to each other. The panels each have two pairs of legs and a pair of cross members. The pairs of legs are spaced apart from each other and have the cross members located between the legs. The spaced apart pairs of legs define a leg slot therebetween. The panels each have a cavity formed therein. The leg slots and the cavities form a storage chamber when the panels are arranged in a linear aligned position. The linear aligned position allows insertion of the table top into the storage chamber for storage and protection of the table top. The table top is removable from the storage chamber when the panels are in the linear aligned position. The panels can be arranged into another position in which all of the panels are generally perpendicular to each adjoining panel. This position allows the table top to be supported on top of the base to form a table.

14 Claims, 6 Drawing Sheets

SPLIT FRAME TABLE

FIELD OF THE INVENTION

This invention relates to a mobile, collapsible table with a self contained space for storing the table top.

BACKGROUND OF THE INVENTION

Homes and offices typically have coffee and end tables arranged with other pieces of furniture. Such coffee and end tables are used for placing lamps, books and other objects thereupon. The conventional coffee and end tables are constructed using one of two techniques. In one technique, the table is completely assembled at the factory. This typically entails the use of fasteners and adhesives such as a glue to permanently affix all of the table members to one another such that they cannot be disassembled. This causes a bulky, unwieldy and heavy table which then has to be transported or carried from the factory to the point of purchase. Shipping such bulky furniture entails using expensive packaging to protect the table during shipping. In another technique of furniture assembly, the furniture is shipped in a knocked down or disassembled fashion and is typically packaged in a cardboard box. This requires the user to spend considerable time after purchase of the unit in assembling the table. Typically, several dozen screws and/or bolts will have to be inserted and tightened in order to complete the table unit. This is inconvenient for the purchaser. It is especially inconvenient if the table is frequently moved. This requires either special arrangements for shipping of the bulky table or spending considerable time disassembling and then reassembling the table unit.

In both prior art construction techniques, after the purchaser has purchased the table typically the packaging with which the table was purchased has been discarded. Subsequently, when it is desired to move the table, its original protective packaging is no longer available.

SUMMARY OF THE INVENTION

A split frame table of this invention has a planar table top and a base. The base has several panels that are joined via hinges to each other. The panels each have two pairs of generally parallel and vertically elongated legs and a pair of generally parallel and horizontally elongated cross members. The pairs of legs are spaced apart from each other and have the cross members located between the legs. The spaced apart pairs of legs define a leg slot therebetween. The legs are positioned perpendicular in relation to the cross members. The legs and cross members define an outer peripheral edge of the panel and also define an inner peripheral edge of the panel. The panels each have a cavity formed therein which is located inwardly of the inner peripheral edge. A fastener such as a dowel connects the cross members to the legs. Hinges are attached between each of the panels. The hinges allow rotation of the panel about an axis parallel to the legs. The hinges are attached to the legs of the panel.

The leg slots communicate with the cavities in the panel to form a storage chamber when the panels are arranged in a linear aligned position. The linear aligned position allows insertion of the table top into the storage chamber for storage and protection of the table top. A stop pin is located in an end panel to prevent the table top from passing through the base after inserting the table top into the base.

The panels can be arranged into a second position in which they are angularly offset to each other. This position allows the table top to be supported on top of the base in a horizontal orientation such that the base and table top form a table.

Figure 1:
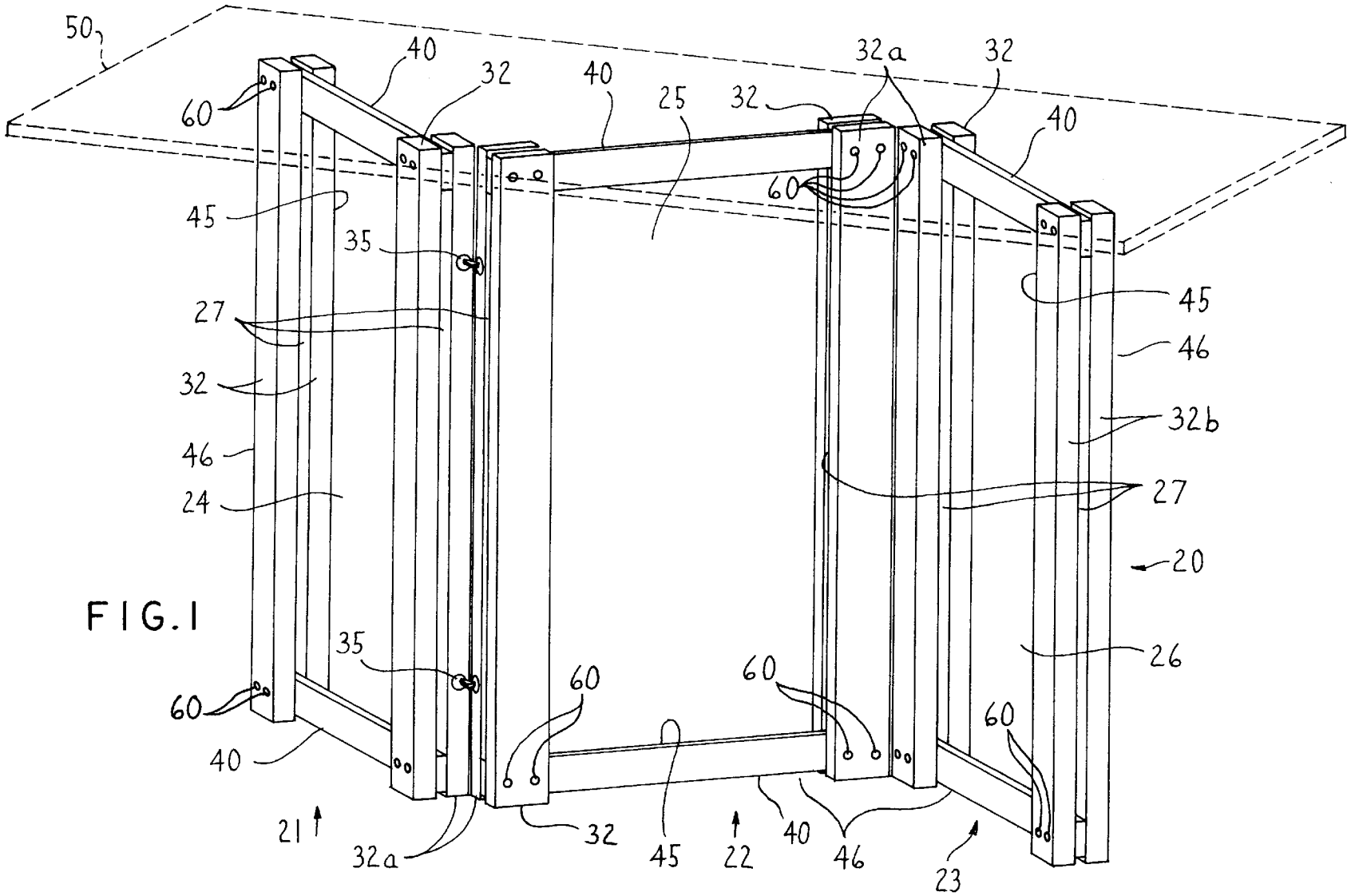
FIG. 1 is a front perspective view illustrating the split frame table in its assembled position with the table top resting on top of the panels.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the table and designated parts thereof. Said terminology will include the words specifically mentioned, derivatives thereof, and words of similar import.

DETAILED DESCRIPTION

Referring to the drawings of the present invention, a portable collapsible coffee or end table is shown. The unit is illustrated in its angled table top supporting position in FIGS. 1–4 and is illustrated in its linearly aligned transportation position in FIGS. 5–8.

Referring to FIG. 1, a generally rectangular planar table top 50 with a defined width is shown resting or attached upon a multi-panel base 20. The table top 50 is made of an aesthetically pleasing material, such as wood, glass, plastic stone, etc. Fragile materials, such as glass or stone, require protection during transportation.

The base 20 has a first panel 21, a middle panel 22 and an end panel 23. More panels may be added if it is desired to make the table longer. Alternatively, panels may be omitted if the table top 50 is of relatively short length. However, a minimum of two panels are required to support the table top 50. The base for an end table is typically made out of two panels. The base for a coffee table typically is made out of three panels.

The panels 21, 22 and 23 are each formed by a connection of horizontally elongated cross members 40 and several different types of vertically elongated legs 32, 32*a* and/or 32*b*. First panel 21 is formed so that two legs 32 form the end of the panel that forms an outer end of the base 20. A leg 32 and a leg 32*a* form the opposed end of first panel 21 that is adjacent middle panel 22. The legs 32, 32*a* and 32*b* have a length that is slightly greater than the width of the table top 50.

Middle panel 22 is formed so that legs 32 and 32*a* form each end of panel 22.

End panel 23 is formed so that two legs 32 and 32*a* form the end of the panel that is adjacent to middle panel 22. Two legs 32*b* form the opposed end of end panel 23. While legs 32*a* and 32*b* have the same general shape and dimensions as legs 32, their distinguishing features will be described below.

Figure 10:
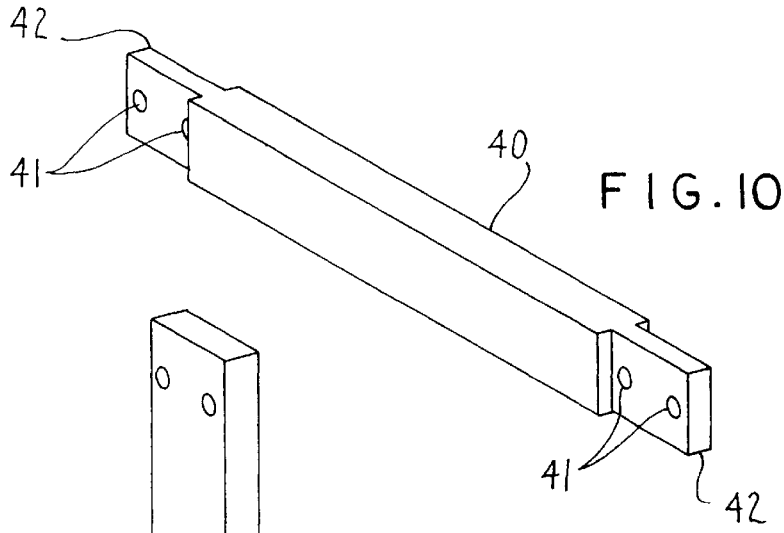
FIG. 10 is a perspective view of a cross member.
Figure 11:
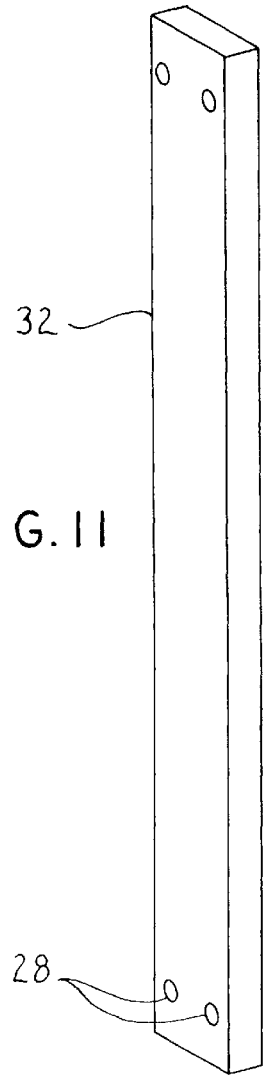
FIG. 11 is a perspective view of a table leg.
Figure 12:
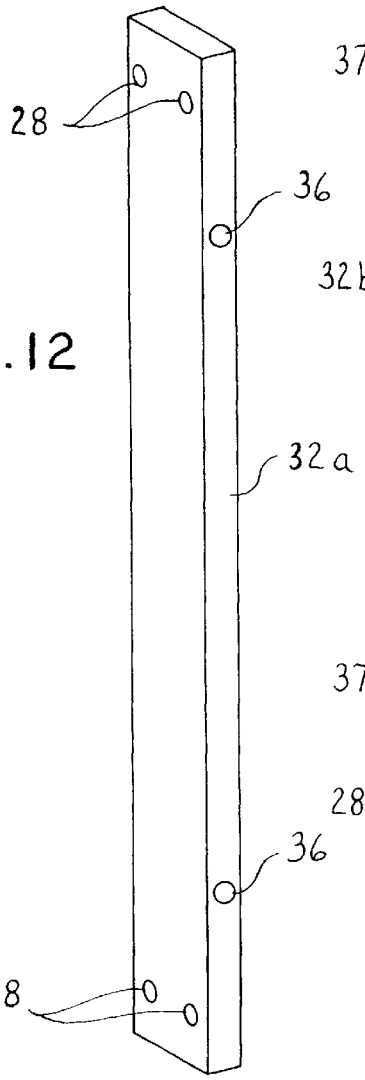
FIG. 12 is a perspective view of a table leg with hinge holes.

Referring to FIG. 10, cross members 40 have a tongue 42 located at each end. Each tongue 42 has pair of holes 41 passing therethrough. Legs 32, 32*a* and 32*b* have a pair of holes 28 located at each end. The tongues 42 are located between various pairs of legs 32, 32*a* and 32*b*. The cross members 40 are oriented perpendicular to the legs 32, 32*a* and 32*b*. Alternatively, cross member 40 could be formed without a tongue 42 and still function in the same manner.

Fasteners such as dowels 60 with adhesive are typically used to hold the legs and cross members together. Other fasteners could be used such as nails, staples or screws. The dowel 60 goes through the tongue 42 and each end of the dowel extends into the leg holes 28 adjacent either side of the tongue 42.

The legs and cross members thus define a generally rectangular shaped panel. The legs 32, 32*a* and 32*b* when spaced apart by cross members 40 form vertically elongated leg slots 27 between the opposing pairs of legs. Leg slots 27 are sized so that the table top 50 can slide through them.

Each panels 21, 22 and 23 have an outer peripheral edge 46 and an inner peripheral edge 45. A first panel cavity 24 is located in the space inside of inner peripheral edge 45. Similarly, panels 22 and 23 have a middle panel cavity 25 and an end panel cavity 26.

Figure 7:
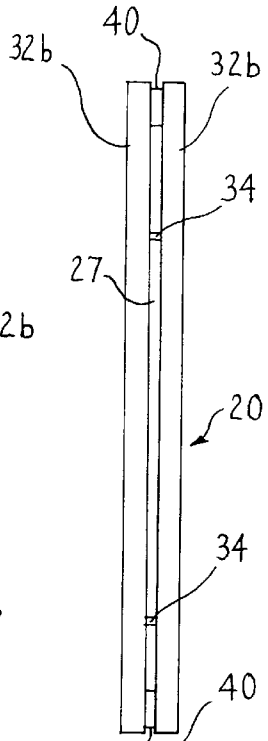
FIG. 7 is a side view of the table unit illustrated in FIG. 5.
Figure 6:
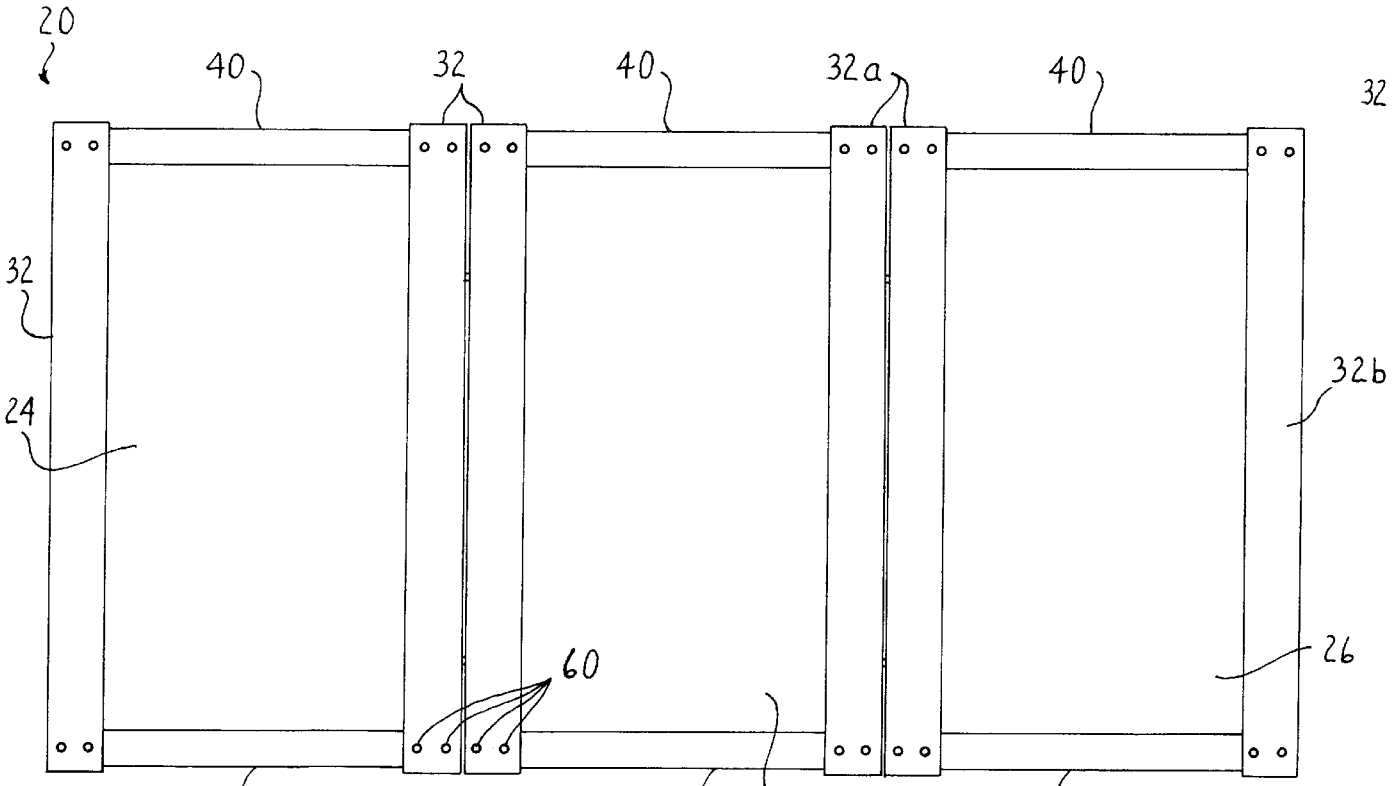
FIG. 6 is a front view of the table unit illustrated in FIG. 5.
Figure 9:
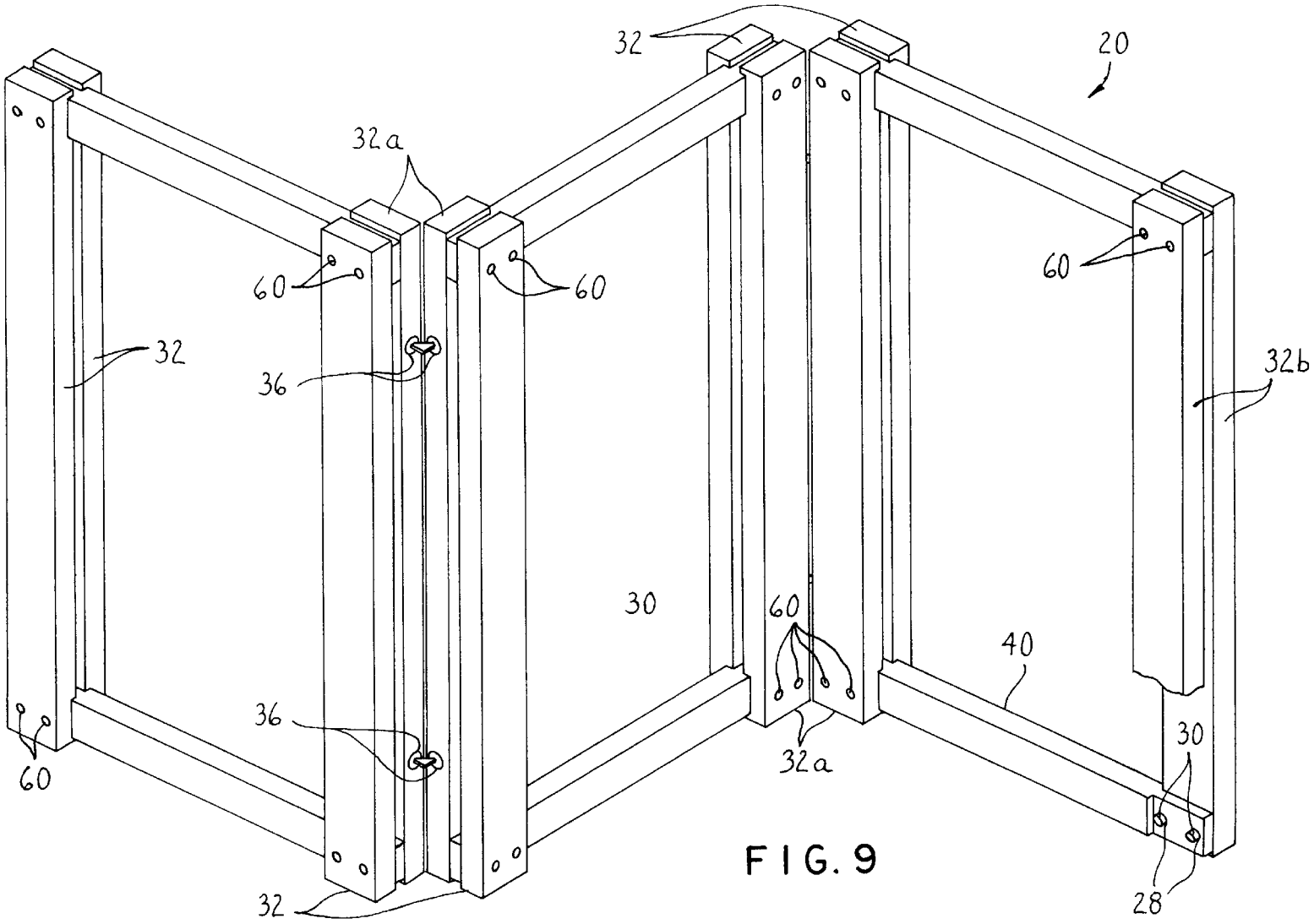
FIG. 9 is a perspective view of the base panels angled to accept the table top on top of the base panels showing the relationship between the holes and apertures of the legs and cross members to the overall assembly.
Figure 13:
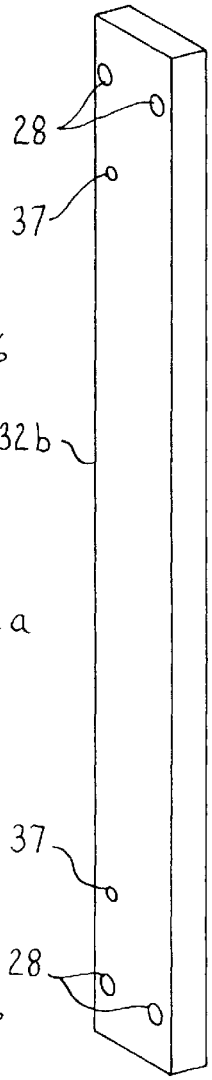
FIG. 13 is a perspective view of a table leg with stop holes.

End panel 23 has a different table leg 32*b* with a stop pin aperture 37. As seen in FIGS. 7 and 13, table leg 32*b* has a stop pin aperture 37 into which a stop pin 34 is inserted. Stop pin 34 has two ends each of which extend into the pair of table legs 32*b*. The stop pin 34 extends across leg slot 27. The stop pin 34 prevents the table top 50 from being pushed beyond and through the base when the table top is being stored.

A pair of hinges 35 rotatably couples first panel 21 to the middle panel 22. The hinge 35 allows rotation of each panel about an axis parallel to the legs. Similarly, middle panel 22 is coupled via hinges 35 to end panel 23. The hinges 35 are attached to the adjacent leg 32*a* of the first and middle panels 21 and 22, respectively and to the adjacent legs 32*a* of the middle and end panel, 22 and 23, respectively. The hinges 35 mount into hinge holes 36. A pair of hinge holes 36 are located on each leg 32*a* as seen in FIG. 13. Fasteners (not identified) secure the hinges 35 in holes 36.

Figure 4:
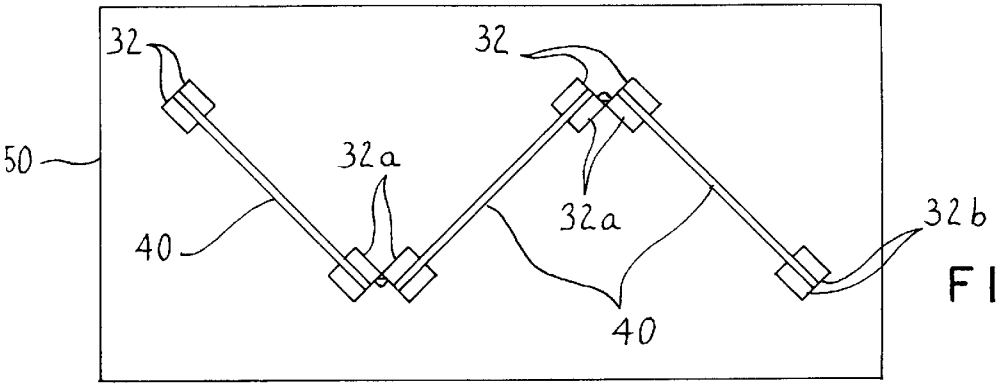
FIG. 4 is a top view of the table illustrated in FIG. 1.
Figure 3:
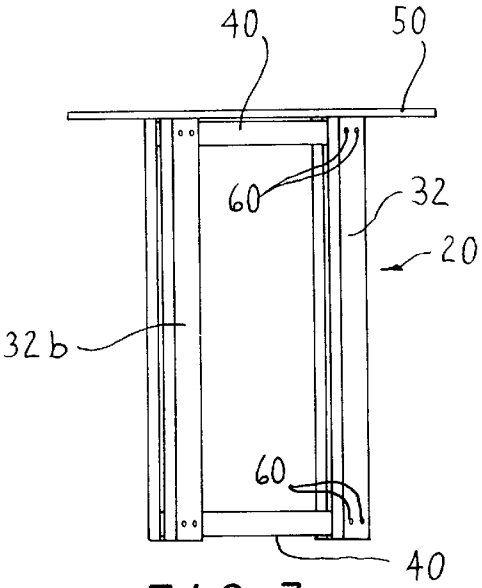
FIG. 3 is a side view of the table illustrated in FIG. 1.
Figure 2:
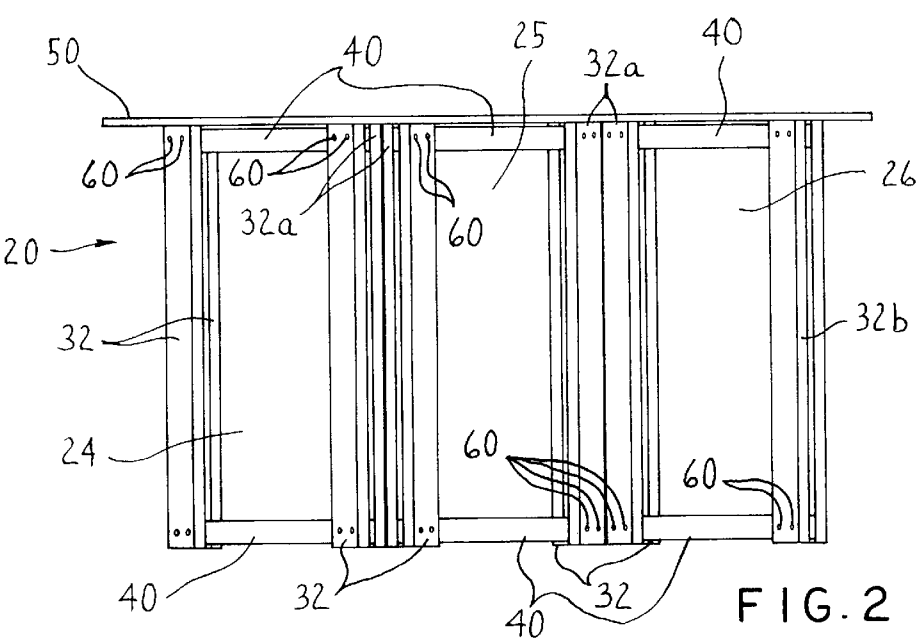
FIG. 2 is a front view of the table illustrated in FIG. 1.

Referring now to FIG. 4, it can be seen that panels 21, 22 and 23 are arranged with each panel perpendicular to each other adjoining panel in a zig-zag configuration. This allows table top 50 to rest on the top of panels 21, 22 and 23 as seen in FIG. 1. This is the in use configuration in which the base is arranged to form a table in conjunction with a table top.

Figure 5:
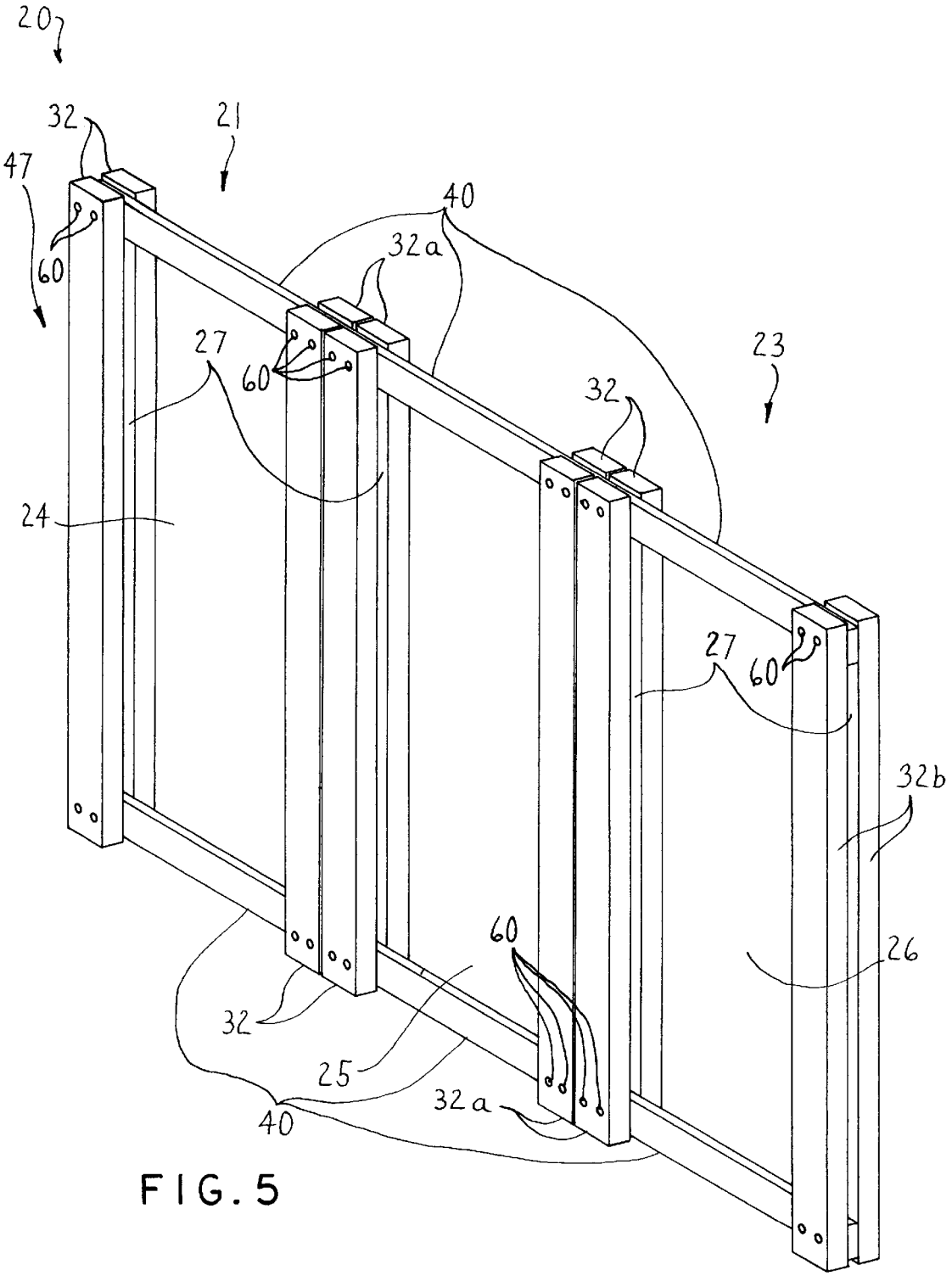
FIG. 5 is generally a front perspective view illustrating the split frame table unit of the present invention in a position for receiving the table top prior to transportation or storage.
Figure 8:
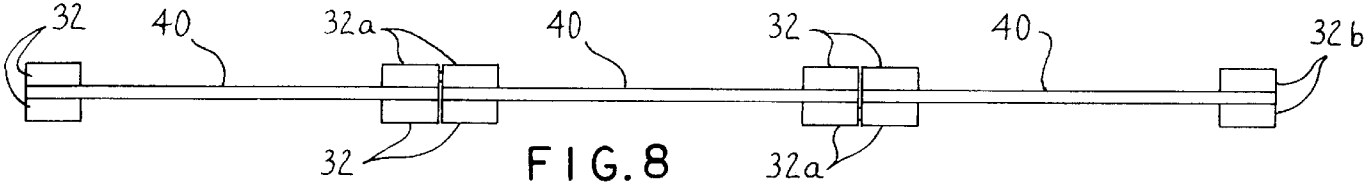
FIG. 8 is a top view of the table unit illustrated in FIG. 5.

Referring now to FIGS. 5–8, the base is shown arranged in a second storage configuration for inserting, storing and protecting the table top 50. In FIG. 5 it can be seen that panels 21, 22 and 23 have been rotated via hinges 35 into a linear aligned position. In this position, the elongated leg slots 27 communicate with the panel cavities 24, 25 and 26 to form a storage chamber 47 therein. Table top 50 is insertable into this storage chamber 47. One edge of table top 50 is inserted into the outermost leg slot 27 formed by first panel 27 and pushed through first panel cavity 24, through the adjoining leg slots 27, through middle panel cavity 25 and through its adjoining leg slots 27 and through end panel cavity 26 and into 32*b*. The stop pin 34 prevents the table top 50 from passing through end panel 23. With the table top thus inserted into the base, the table is now stored and protected and is readily transportable in a convenient package with minimizes space requirements.

To reassemble the table, the table top 50 is withdrawn or retracted from the base 20. Table top 50 is withdrawn through leg slots 27 and first, middle and end panels cavities 24, 25 and 26, respectively. The panels are then rotated back into their perpendicularly adjoining positions and the table top 50 placed on top of the panels 21, 22 and 23 to form the table.

The foregoing description is limited to one preferred embodiment of the invention. It should be clear, however, that the structure of the invention may differ from what has been described and illustrated. For example, more than three panels may be appended together to form the base assembly of the table. Four panels could be used to form a square table base or six panels could be used to form a hexagonal table base. The panels do not necessarily have to be rectangular or square, they could be any number of shapes such as triangular, hexagonal, pentagonal or trapezoidal.

The panels could be formed out of sheets of solid material in place of the legs. With a solid sheet, the panels sides would be completely covered.

Also, there is no requirement that when the base is in the in-use position all the panels be connected to form a unitary base. A latch mechanism may be provided to allow the panels to be disassembled into groups. That the base could actually take the form of two or more disconnected legs, wherein at least one leg is formed from two hingedly connected panels.

Further, a latch structure could be attached to first panel 21 in order to secure the table top within the storage chamber during transportation.

The connecting mechanisms between the panels need not always be limited hinges. For example, flexible plastic connectors could be utilized joining the panels. Two types of flexible plastic connectors could be used. A straight connector is used for the in line storage position and an angled connector is used for the in-use position.

Further the base assembly is not limited to storing only table tops. The base assembly could be utilized for storing any planar surface that is fragile and requires protection during shipping or moving.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A table comprising:

a planar table top having a defined width; and a base for supporting said table top, said base being formed out of a plurality of panels that are connected together, each said panel being shaped to define a storage cavity that extends from one end of said panel to an opposite end of said panel and having a length substantially equal to the width of said table top, said base having a first position wherein two adjacent said panels are angularly offset from each other for supporting said table top and a second position wherein said panels are linearly aligned so that said storage cavities are linearly aligned so that said table top is storable within said storage cavities.

2. The table according to claim 1, wherein at least one hinge is attached between adjacent said panels, said hinge allowing rotation of said adjacent panels between said first and second positions.

3. The table according to claim 1, wherein said panels each have two pairs of parallel and vertically elongated legs and a pair of parallel and horizontally elongated cross members, said pairs of legs being spaced apart from each other and having said cross members located between said legs, each said pair of legs defining a vertically elongated leg slot between said legs, fastener means connecting said cross members to said legs, wherein said table top is inserted through said leg slots.

4. The table according to claim 1, wherein one of said panels has, at one side end thereof, at least one stop pin for preventing said table top from passing through said base after insertion of said table top into said base when said panels are in said second position.

5. The table according to claim 1, wherein said table top is formed from glass.

6. The table according to claim 1, wherein said base is formed by three said panels.

7. A split frame table comprising:

a planar table top;

a base having a plurality of panels, said panels hingedly connected to each adjacent said panel; said panels each having two pairs of parallel and vertically elongated legs and a pair of parallel and horizontally elongated cross members said pairs of legs spaced apart from each other and having said cross members located between said legs, each pair of legs defining a vertically elongated leg slot between said legs, said legs positioned perpendicular to said cross members, said legs and said cross members defining an outer peripheral edge of said panel and an inner peripheral edge of said panel, said panels each having a cavity therein located inwardly of said inner peripheral edge wherein, each said panel cavity is contiguous with said leg slots of said panel;

fastener means connecting said cross members to said legs;

at least one hinge attached between each adjacent said panels, said hinge allowing rotation of said panels about an axis generally parallel to said vertically elongated legs, said hinge having a first end affixed to one of said legs on one said panel and a second end affixed to one of said legs on another said panel; and, said panels being movable between a first linearly aligned position for containing said table top during storage and transportation of said table wherein, when said panels are in the first position, said table top is insertable into said leg slots and seats in said cavities and is removable from said base, and a second angled position for supporting said table top such that said table top rests on said base in the second position to form said table.

8. The table according to claim 7, wherein one of said panels has one of said pairs of legs with at least one stop pin for preventing said table top from passing through said base after insertion of said table top into said base when said panels are in said first position.

9. The table according to claim 7, wherein said table top is formed from glass.

10. The table according to claim 7, wherein said base is formed by three said panels.

11. A split frame table comprising:

a planar table top; and a base having:

a plurality of panels, said panels each having first, second, third and fourth generally parallel and vertically elongated legs and first and second generally parallel and horizontally elongated cross members that are spaced apart from each other, wherein, said first and second legs are spaced apart from each other to define a first leg slot therebetween, said third and fourth legs are spaced apart from each other to define a second leg slot therebetween and each said cross member has a first end located between said first and second legs and a second end located between said third and fourth legs so that said cross members and said legs define a cavity therebetween on each of said panels, the cavity being between the leg slots of said panel;

fastener means rigidly attaching said cross members to said legs; and at least one hinge attached between adjoining said panels, said hinge allowing rotation of said panels about an axis generally parallel to said vertical elongated legs, said hinge having a first end affixed to one of said legs on one panel and a second end affixed to one of said legs on another panel;

wherein, the leg slots communicate with the cavities to form a storage chamber when said panels are arranged in a first position, the first position characterized in that all of said panels are linearly aligned, said first position allowing insertion of said table top into the storage chamber for storage and protection of said table top, said table top further being removable from the storage chamber when said panels are in the first position; and, said panels are arrangeable in a second position, the second position characterized in that a plurality of said panels are generally perpendicular to each adjoining said panel, said second position allowing said table top to be supported on top of said base in a generally horizontal orientation such that said base and said table top form said table.

12. The table according to claim 11, wherein one of said panels has one of said legs with at least one stop pin for preventing said table top from passing through said base after insertion of said table top into said base when said panels are in the first position.

13. The table according to claim 11, wherein said table top is formed from glass.

14. The table according to claim 11, wherein said base is formed by three said panels.

* * * * *